US005783832A

United States Patent [19]

Sandor

[11] Patent Number: 5,783,832

[45] Date of Patent: Jul. 21, 1998

[54] PACKAGING WITH CENTRIFUGE TUBE

[75] Inventor: Joseph Sandor, Balboa Island, Calif.

[73] Assignee: ICN Pharmaceuticals, Inc., Costa Mesa, Calif.

[21] Appl. No.: 822,039

[22] Filed: Mar. 24, 1997

Related U.S. Application Data

[60] Provisional application No. 60/025,119, Aug. 30, 1996.

[51] Int. Cl.[6] ..... G21F 5/00

[52] U.S. Cl. ..... 250/506.1

[58] Field of Search ..... 250/506.1, 505.1, 250/515.1

[56] References Cited

U.S. PATENT DOCUMENTS

| | | | |
|---|---|---|---|
| 3,655,985 | 4/1972 | Brown et al. | 250/506.1 |
| 4,020,355 | 4/1977 | Czaplinski et al. | 250/506.1 |
| 4,081,688 | 3/1978 | Fries | 250/506.1 |
| 4,144,461 | 3/1979 | Glasser et al. | 250/506.1 |

*Primary Examiner*—Kiet T. Nguyen

*Attorney, Agent, or Firm*—Crockett & Fish; Robert D. Fish

[57] ABSTRACT

A packaging system for the transportation and storage of materials, including radioactive and other hazardous materials. The system comprises a primary container removably received within a secondary container, and the secondary container being removably received within a tertiary container. The primary container can be centrifuged to minimize unrecoverable material, and in especially radioactive materials, the primary container is the only component that must be considered as radioactive waste.

17 Claims, 2 Drawing Sheets

PACKAGING WITH CENTRIFUGE TUBE

This application claims priority to Provisional Patent Application Ser. no. 60/025,119, filed Aug. 30, 1996, now abandoned.

I. FIELD OF THE INVENTION

The field of the invention is hazardous materials packaging.

II. BACKGROUND OF THE INVENTION

Radioactive and other hazardous materials having medical and scientific value are often transported in small quantities by common carriers, and are often stored in offices and laboratories having little or no special storage facilities. As a result, such materials can pose significant potential threats to public health and safety. Where the hazardous materials contained in the shipping and storage containers are not completely removed, there is yet a further problem resulting from the disposal of the containers.

These problems are reflected in numerous government regulations, such as 10 CFR 20, which set forth stringent requirements for transportation and storage of radioactive materials. Satisfaction of such requirements often entails expensive and cumbersome packaging. There are exceptions to the general requirements which involve less costly packaging, but the limitations imposed by the exceptions are not always acceptable. For example, U.S. Pat. No. 5,042,679 to Crowson et al., describes a device which is intended to satisfy the requirements of 49 CFR 173.43(z). That section provides somewhat less stringent regulations for encapsulation of small quantities of radioactive materials which cannot be directly accessed without destruction of the container. Such devices, however, are limited to "single use" embodiments, and are therefore not generally suited for transportation and storage of medical and scientific radioactive materials.

It is known to provide multiple use shipping and storage containers in which a hazardous material is enclosed within an inner container, and the inner container is itself removably enclosed within an outer container. In addition to providing double walled protection from puncture and the like, such systems allow the inner container to be removed from the outer container for ease of handling. See, for example, U.S. Pat. No. 4,783,309 to Popp et al.

The known systems do not, however, resolve certain problems encountered in accessing materials held within. For example, where the walls of an inner container are visually impenetrable or opaque, it may be difficult to visualize any material remaining within the container. This is especially problematic for clear or translucent materials, and for materials shipped or stored quantities of only a few milliliters or less. The contained material may also adhere to the sides of the inner container, making it difficult to remove all potentially available material.

The known systems also do not resolve certain problems associated with disposal. For example, where the inner container is bulky, disposal may involve disposing of an unnecessarily large container.

Thus, a need exists to provide improved materials packaging which provides adequate protection during transportation and storage, while reducing problems associated with handling and disposal.

III. SUMMARY OF THE INVENTION

In the present invention, a packaging system is provided for the transportation and storage of materials, including especially radioactive and other hazardous materials. The system comprises a primary container removably received within a secondary container, and the secondary container removably received within a tertiary container. In preferred embodiments the primary container is adapted to be centrifuged to minimize the amount of unrecoverable material, and in especially preferred embodiments involving radioactive materials, the primary container is the only component that must be considered as radioactive waste under current federal regulations.

Various objects, features, aspects and advantages of the present invention will become more apparent from the following detailed description of preferred embodiments of the invention, along with the accompanying drawings in which like numerals represent like components.

IV. BRIEF DESCRIPTION OF THE DRAWINGS

V. DETAILED DESCRIPTION

Figure 1:
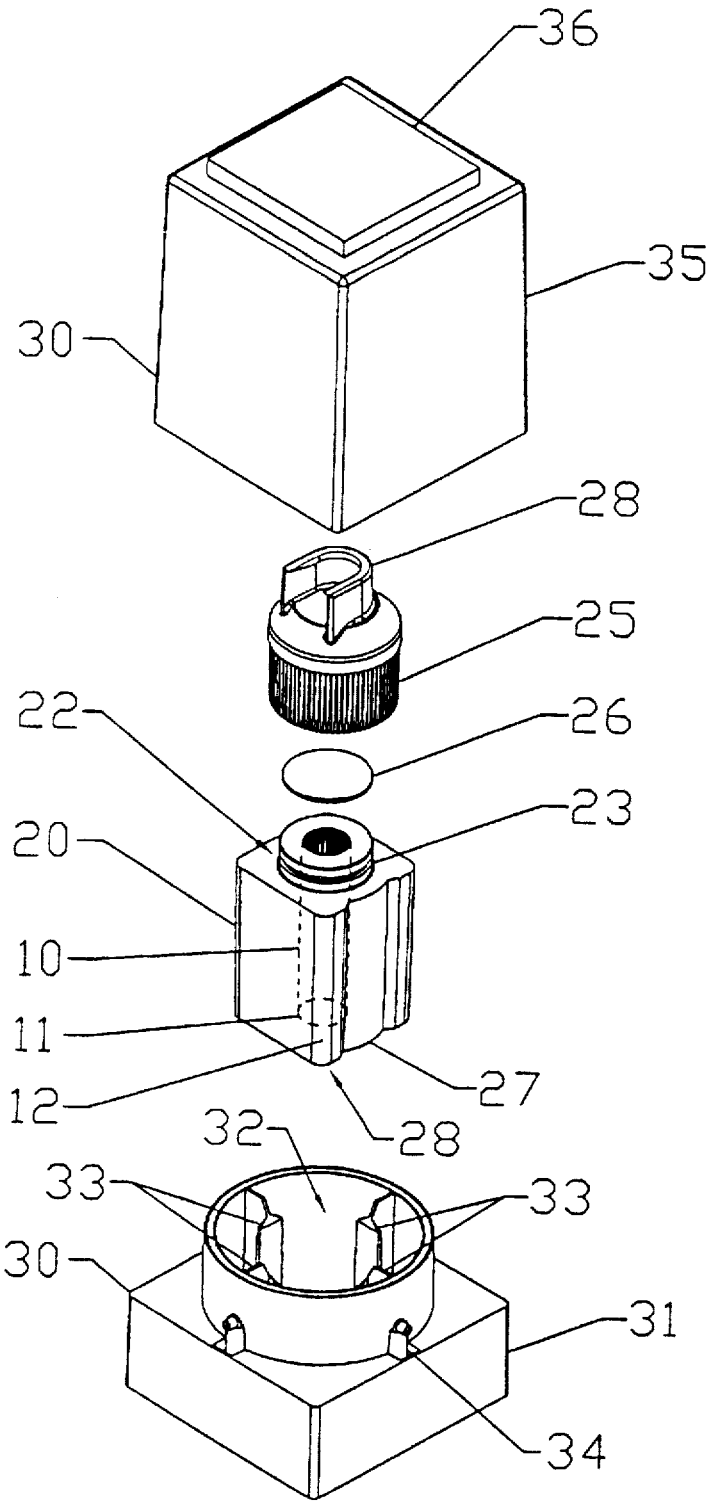
FIG. 1 is an exploded perspective view of a packaging system according to the invention.
Figure 2:
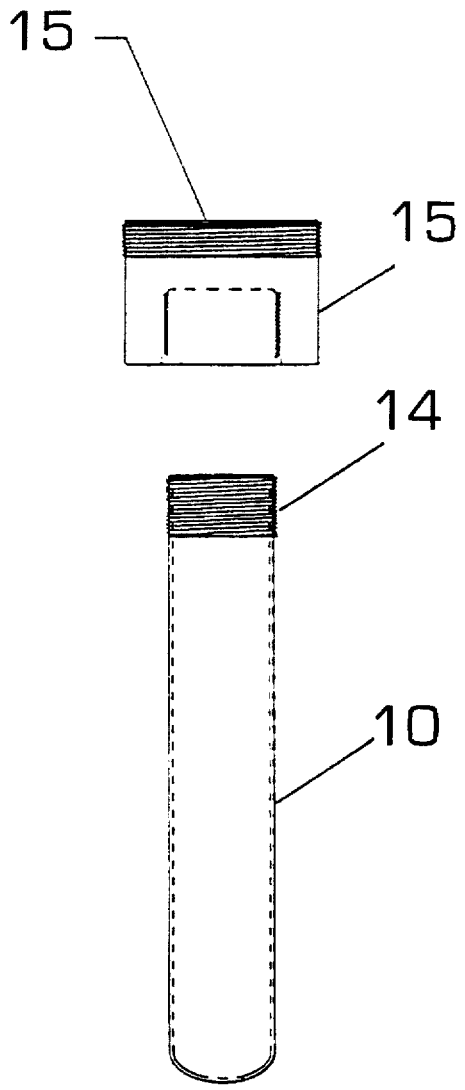
FIG. 2 is a perspective view of a primary container with optional inner screw cap according to the invention.

Referring to FIGS. 1 and 2, a packaging system 1 generally comprises a primary container 10, a secondary container 20 and a tertiary container 30. The primary container 10 is removably received by the secondary container 20, and the secondary container 20 is removably received by the tertiary container 30.

In preferred embodiments the primary container 10 comprises a centrifuge tube. For transport of common radiochemicals such as and $^{32}P$, $^{35}S$, $^{33}P$, $^{3}H$ and $^{14}C$ the centrifuge tube is advantageously sized to accommodate between about 0.01 ml and about 1 ml of radioactive material. Both larger and smaller size tubes, however, are also contemplated. In many cases the primary container 10 tube is a "microcentrifuge tube" which is intended to be centrifuged within a device specifically adapted to small tubes, or centrifuged within a standard laboratory centrifuge using an adaptor. In any event the term "centrifuge tube" is defined herein to mean tubes which are narrowed at the bottom end 11 in a softened conical shape. This has the dual benefit of enhancing the collection of very small amounts of material 12 during centrifuging, and also enhancing the visibility and recovery of small amounts.

The primary container 10 can be constructed of many different materials. Plastic is presently preferred for radiochemicals and the like which may adhere onto, or dissolve other compositions, although the primary container may comprise glass, metals or other compositions as well. The walls of the primary container 10 may thus be transparent, translucent, colored, entirely opaque, or have other desirable characteristics, depending upon the material contained therein.

Referring now primarily to FIG. 1, the secondary container 20 contains a channel 21 sized and dimensioned to removably receive the primary container 10. The secondary container 20 is also advantageously sealable at its upper end 22, preferably with a pressure-sealed "O"-ring. To this end the upper end 22 of the secondary container 20 includes a channel 23 which cooperates to seal against receiving cap 25. The cap 25 is preferably made from high density suitable plastics . . . . The "O"-ring 26 is preferably positioned between the secondary container 20 and the cap 25.

In this manner the primary container 10 is completely enclosed within a cavity defined by the secondary container 20 and the cap 25, and the material 12 contained within the primary container 10 is thereby precluded from escaping. Optionally, an inner screw cap or other type of stopper (not shown) can be removably fitted to the upper end of the primary container 10 before the primary container 10 is inserted into the channel 21, and the cap 25 is pressure-sealed onto the secondary container 20. Yet another option is for a finger (not shown) to extend downwards from the cap 25 or "O"-ring 26, such that the finger is received by the open upper end of the primary container 10 when the cap 25 is screwed onto the secondary container 20, and the finger thereby acts as a stopper.

The secondary container is preferably constructed of an impact resistant material, which especially in the case of a packaging system used for radioactive materials, may comprise polycarbonate. The secondary container may be produced according to any satisfactory production technique, and is preferably injection molded to minimize production costs. Where the secondary container is made of a relatively transparent composition, one of the sides may include a convex portion 27 which acts as a magnifying lens to improve visibility of the material 12 contained within the primary container 10. In preferred embodiments the secondary container 20 also has a bottom 28 which is sufficiently flat, has three or more legs, or has some other shape which assists in maintaining its stability on a work bench or table top. Additionally, the secondary container 20 may have relatively flattened sides and rounded comers to prevent rolling, and to enhance its ornamental appearance.

The tertiary container 30 preferably comprises a flat bottomed, rectangular or square sided base 31 which defines a cavity 32 sized and dimensioned to receive a bottom portion of the secondary container 20. The tertiary container is preferably constructed of an impact resistant material such as polypropylene. Inner flanges 33 secure the secondary container 20 within the tertiary container, but allow for its easy removal. The squarish shape of the base 31 is intended to provide protection against the system rolling should it inadvertently be tipped over, as well as the appearance of stability. The tertiary container 30 also includes a cover 35 which fits onto outer flanges 34, using a "V" seal (not shown). In particularly preferred embodiments, the cover 35 may include a lip or raised portion 36 which is received by a complementary recess (not shown) in the bottom of the base 31, to enhance stackability and to thereby reduce storage space.

The container system 1 described herein is preferably used as follows. The material 12 to be transported and/or stored is loaded into the primary container 10. An "O"-ring 16 is fitted into a cap 15, and the cap 15 is screwed onto the threads 14 of the primary container 10. The primary container 10 is then placed into the receiving cavity 21 of the secondary container 20, which in turn is placed into the receiving cavity 32 of the base 31 of the tertiary container 30.

Removal of the material 12 involves reversal of these steps. First, the cover 35 of the tertiary container 35 is removed from the base 31, and the secondary container may or may not be removed from cavity 32, depending up the user's preference. The cap 25 of the secondary container 20 can then be removed, leaving the primary container 10 either open, or still closed by an inner screw cap 15 or other stopper. If an inner screw cap 15 or other stopper is present, it too is removed. In this action, the upper portion 28 of the screw cap 25 may be inverted and used as a tool to twist off the inner screw cap 15, where present.

The amount of material 12 within the primary container 10 may be visualized through the magnifying portion 27 of the secondary container 20 when the primary container 10 lies in situ within the secondary container cavity (not numbered), or it may be visualized by removing the primary container 10 from the secondary container 20, and inspecting the contents more directly. Of course, the secondary container 10 can be centrifuged to enhance visualization or removal of any remaining material 12.

Thus, a novel packaging system has been disclosed. While specific embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A packaging system for a radioactive material, comprising:

a centrifuge tube;

a radioactive transmission attenuating housing, the housing having a first cavity which removably receives at least part of the centrifuge tube.

2. The packaging system of claim 1 further comprising a pressure sealed cap mating with a portion of the housing, and securing at least part of the centrifuge tube within the first cavity.

3. The packaging system of claim 1 further comprising a pressure-sealed cap mating with a portion of the housing, the cap and the housing cooperating to completely enclose the centrifuge tube within the first cavity.

4. The packaging system of claim 3 wherein the housing includes a lens which improves visibility of the radioactive material in the centrifuge tube relative to visibility of the radioactive material in the centrifuge tube without the lens.

5. The packaging system of claim 4 wherein the lens comprises a magnifying lens.

6. The packaging system of claim 1 wherein the housing comprises polycarbonate.

7. The packaging system of claim 1 wherein the centrifuge tube comprises plastic.

8. The packaging system of any of claims 1–7 further comprising a canister and cap which cooperate to form a second cavity sized and dimensioned to receive the housing and the cap.

9. The packaging system of claim 8 wherein the canister and cap each comprised of an impact-resistant material.

10. A packaging system for transporting or storing a hazardous material, comprising:

a primary container comprising a centrifuge tube;

a protective secondary container having a first cavity which removably receives at least part of the primary container;

a cap which mates with a portion of the secondary container and secures the primary container within the first cavity; and a canister and cap which cooperate to form a second cavity sized and dimensioned to receive the secondary container and the cap.

11. The packaging system of claim 10 wherein the cap and the secondary container cooperate to completely enclose the primary container within the first cavity.

12. The packaging system of claim 11 wherein the secondary container includes a lens which improves visibility of the radioactive material in the primary container relative to visibility of the radioactive material in the primary container without the lens.

13. The packaging system of claim 12 wherein the lens comprises a magnifying lens.

14. The packaging system of claim 10 wherein the secondary container comprises polycarbonate.

15. The packaging system of claim 10 wherein the primary container comprises plastic.

16. The packaging system of any of claims 10–15 wherein the secondary container comprises a radioactive transmission attenuating material.

17. The packaging system of any of claims 10–15 wherein the canister and cap each comprise an impact-resistant material.

* * * * *